US009457926B2

(12) United States Patent
Schach

(10) Patent No.: US 9,457,926 B2
(45) Date of Patent: Oct. 4, 2016

(54) METHOD AND DEVICE FOR TREATING PACKAGING MEANS BY APPLYING DECORATIONS

(75) Inventor: Martin Schach, Bochum (DE)

(73) Assignee: KHS GmbH, Dortmund (DE)

( * ) Notice: Subject to any disclaimer, the term of this patent is extended or adjusted under 35 U.S.C. 154(b) by 175 days.

(21) Appl. No.: 14/344,958

(22) PCT Filed: Aug. 4, 2012

(86) PCT No.: PCT/EP2012/003338
§ 371 (c)(1),
(2), (4) Date: Mar. 14, 2014

(87) PCT Pub. No.: WO2013/037442
PCT Pub. Date: Mar. 21, 2013

(65) Prior Publication Data

US 2014/0374016 A1 Dec. 25, 2014

(30) Foreign Application Priority Data

Sep. 14, 2011 (DE) ..... 10 2011 113 150

(51) Int. Cl.
*B41J 3/407* (2006.01)
*B65C 9/46* (2006.01)
*B65C 9/02* (2006.01)
*B65C 9/08* (2006.01)
(Continued)

(52) U.S. Cl.
CPC ..... *B65C 9/46* (2013.01); *B41J 3/4073* (2013.01); *B65C 3/06* (2013.01); *B65C 3/14* (2013.01); *B65C 9/04* (2013.01); *B65C 9/26* (2013.01)

(58) Field of Classification Search
CPC ..... B41J 3/4073; B65C 3/06; B65C 3/14; B65C 9/04; B65C 9/18; B65C 9/46
USPC ..... 156/447, 582, DIG. 26
See application file for complete search history.

(56) References Cited

U.S. PATENT DOCUMENTS 5,458,714 A * 10/1995 Brandt ..... B44C 1/1712 156/237
8,418,608 B2 * 4/2013 Preckel ..... B41J 2/175 101/36

(Continued)

FOREIGN PATENT DOCUMENTS

DE 10 2006 001 204 10/2007
DE 10 2007 050 490 4/2009

(Continued)

OTHER PUBLICATIONS

English translation of EP0577977.*

(Continued)

*Primary Examiner* — Sonya Mazumdar
(74) *Attorney, Agent, or Firm* — Occhiuti & Rohlicek LLP

(57) ABSTRACT

A method for applying decorations to packages includes applying a main decoration to the package, and applying a detachable part label with a reduced adhesion strength. The part label is provided on a region of the main decoration and takes up part of a surface region of the main decoration. The part label is printed on by using a digital printing process controlled by a computer that relies on a digital printing mask that is stored or generated by the computer. The computer controls the print head to cause it to print a print on the part label after the part label has been applied to the package.

20 Claims, 4 Drawing Sheets

(51) Int. Cl.

| | |
|---|---|
| ***B65C 9/20*** | (2006.01) |
| ***B65C 9/26*** | (2006.01) |
| ***B65C 3/06*** | (2006.01) |
| *B65C 9/04* | (2006.01) |
| *B65C 9/22* | (2006.01) |
| *B65C 3/14* | (2006.01) |

(56) References Cited

U.S. PATENT DOCUMENTS

| | | | | |
|---|---|---|---|---|
| 8,667,895 | B2 * | 3/2014 | Gerigk | B41J 3/4073 101/35 |
| 8,974,015 | B2 * | 3/2015 | Fischer | B41J 29/393 347/2 |
| 9,162,440 | B2 * | 10/2015 | Schach | B08B 15/007 |
| 2002/0185212 | A1 * | 12/2002 | Schaupp | B65C 9/04 156/205 |
| 2004/0007557 | A1 | 1/2004 | Maliszewski et al. | |
| 2006/0249582 | A1 * | 11/2006 | Golabek | B01L 3/5453 235/462.01 |
| 2009/0160901 | A1 * | 6/2009 | Achhammer | B41J 2/16505 347/29 |
| 2010/0257819 | A1 * | 10/2010 | Schach | B41J 3/4073 53/411 |
| 2010/0281833 | A1 | 11/2010 | Mattos, Jr. et al. | |
| 2011/0041979 | A1 * | 2/2011 | Leykamm | B65C 3/06 156/60 |

FOREIGN PATENT DOCUMENTS

| | | | | |
|---|---|---|---|---|
| DE | 10 2008 012 502 | | 9/2009 | |
| DE | 10 2008 049 241 | | 4/2010 | |
| DE | 10 2008 051 791 | | 4/2010 | |
| DE | 10 2009 043497 | | 3/2011 | |
| DE | 102009043497 | A1 * | 3/2011 | B41J 3/4073 |
| EP | 0 577 977 | | 3/1997 | |
| WO | WO 99/08935 | | 2/1999 | |
| WO | WO 2010/034375 | | 4/2010 | |

OTHER PUBLICATIONS

English translation of DE102008051791.*
English translation of DE102008012502.*
English translation of DE102007050490.*
English translation of DE102009043497.*

* cited by examiner

METHOD AND DEVICE FOR TREATING PACKAGING MEANS BY APPLYING DECORATIONS

RELATED APPLICATIONS

This application is the national stage of PCT application PCT/EP2012/003338, filed Aug. 4, 2012, which claims the benefit of the Sep. 14, 2011 priority date of German application DE 102011113150.0, the contents of which are herein incorporated by reference.

FIELD OF INVENTION

The invention relates application of decorations to packages.

BACKGROUND

Devices are known in which the packaging means are held on one and the same holding-and-centering unit (puck) throughout the entire transport from the package inlet to the package outlet. In such devices, the holding-and-centering units only release the packages at the package outlet. From there, the holding-and-centering units are moved back to the package inlet on a puck return transport line.

Furthermore, printing systems or printing stations are known for printing containers using digital, electric print heads working on the inkjet principle. In known printing systems or printing machines, multiple treatment or printing positions, each holding a container to be printed, are formed on a transport element that is driven to rotate about a vertical axis. The containers are printed on using electronically controllable, digital print heads working on the inkjet principle.

Methods are also known for labeling packages, in particular containers or bottles, with labels that, for example, are first printed on-site, i.e. directly before application to the packages, using suitable printing methods, for example using digital print heads. These can be individual labels or roll labels. Printing can then take place, for example, with advertising messages, product marks, and/or product names, and with the necessary and required notices and information. The printed labels are applied to the packages with labeling machines of conventional design.

Peel-off labels are also known. Such labels include multilayer labels comprising a carrier label that is attached to the packages with a high adhesion strength, and at least one detachable part label printed with a part decoration. This is held on the carrier label with a reduced adhesion strength and covers only a reduced surface region of the carrier label. The respective part label can, for example, be detached by a purchaser or consumer of the product filled in the packages, and offers for example the potential for actions promoting sales, such as promotional actions, and/or event-related or event-oriented activities or promotions. For this the part labels can, for example, be applied to the packages in the form of peel-off lottery numbers and/or collection labels that can then be affixed to albums, game cards, etc.

The size, shape and decoration of these known peel-off labels are restricted to the respective promotion. Changes, in particular, to the part decoration of the detachable or peel-off part labels, are possible only with a relatively long lead time. As a result, in practice, it is not possible to react quickly and flexibly to current events, for example to sporting events and/or results, by changing the part decoration of the detachable part label quickly and flexibly.

Another disadvantage of known peel-off labels is that the respective quantity and event-oriented information content of the labels must be planned far in advance.

SUMMARY

The object of the invention is to find a method in which, with a high operating reliability, it is possible to change and/or adapt the decoration of packages, with regard to the part decoration of the detachable part label, rapidly and flexibly, where applicable in an event-related or event-oriented manner.

In a preferred embodiment of the invention, the decoration is applied using peel-off labels but with empty or unprinted or only partially printed detachable part labels that are only printed after application of the respective peel-off label to a package.

A particular advantage of this embodiment of the method according to the invention is that by far the largest part of the respective total decoration is already present, pre-printed on the carrier label, and only a small part of this decoration, namely the part decoration of the detachable part label, must be produced by printing the part peel-off label already applied to the package, during the on-going process. Thus the printing cost and hence the machine and material cost for printing, and the time required for printing, are greatly reduced. The detachable part labels are printed "just in sequence", and preferably with electronically controlled printing stations or print heads, preferably with print heads working on the inkjet process and known to the person skilled in the art, with controlled movement, for example with controlled rotational or swivel movement of the package relative to the respective print head.

"Peel-off labels," as used herein, are generally labels, including individual or roll labels, that have at least a carrier or main label and at least one part label, the surface dimensions of which are smaller than the surface dimensions of the carrier label and that is provided on the carrier label detachably i.e. with reduced adhesion strength, preferably using a self-adhesive layer.

An "orientation feature," as used herein, is a feature on the package that e.g. can be scanned mechanically and/or optically and that allows orientation of the package.

A "package feature," as used herein, is an orientation feature caused by the shaping of the package.

A "main decoration," as used herein, is the package decoration that is applied to the respective package and not covered by the respective part label or its decoration or part decoration, and that is formed either by printing directly onto the outer surface of the package or preferably by printing of the carrier label of the peel-off label.

A "package," as used herein includes a pack or container that is used in the foodstuff sector and particularly in the drinks sector, and in particular containers such as bottles, cans and also soft packs, for example, those made of cardboard, plastic film, and/or metal film.

As used herein, a "puck" is a holding, centering, and orientation unit for the package on which the respective package is held and moved from the package inlet to the package outlet through a package transport line of the transport system, and that here preferably also causes a controlled orientation of the respective package for its treatment.

"Transport elements adjacent to each other for transport" in the sense of the invention are transport elements or transport and handling elements that are configured and arranged such that, at the delivery regions, they take the pucks from a transport element upstream in the transport direction, hold them, and pass them on to the transport element downstream in the transport direction.

The expression "substantially" or "approximately" in the sense of the invention includes deviations from the precise value by ±10%, preferably by ±5%, and/or deviations in the form of changes insignificant to function.

Refinements, advantages, and possible applications of the invention arise from the description below of exemplary embodiments and the figures. All features described and/or shown in the figures, alone or in any combination, form the fundamental subject of the invention irrespective of their summary in the claims or back reference. The content of the claims is also made an integral part of the description.

BRIEF DESCRIPTION OF THE DRAWINGS

The invention is described in more detail below with reference to exemplary embodiments in the figures. These show.

DETAILED DESCRIPTION

Figure 1:
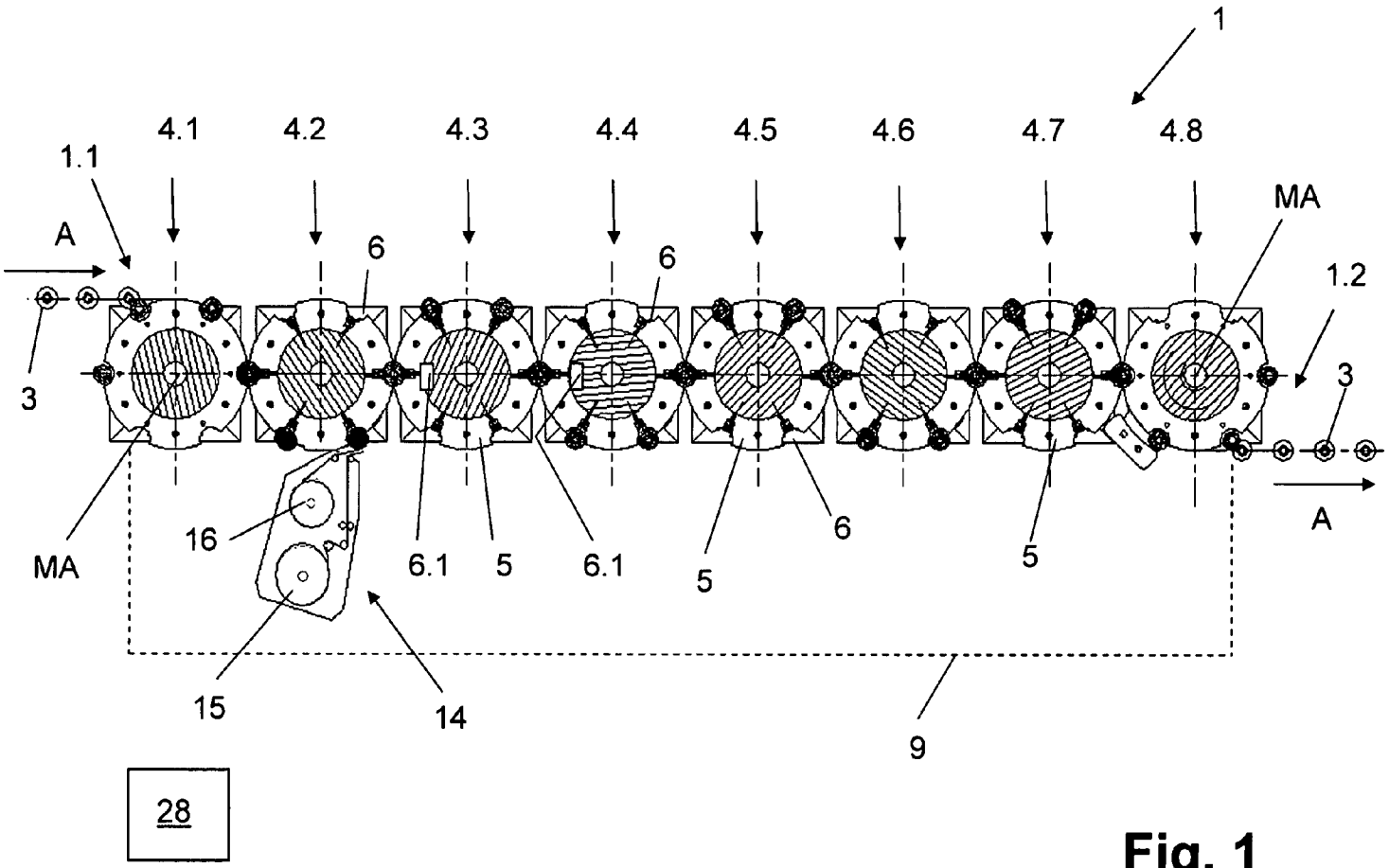
FIG. 1 shows a diagram of a top view of a plant or device for treating packages in the form of containers by the application of a decoration, at least in the form of a peel-off label, to each package.

A first device 1 in FIG. 1 applies at least one decoration at least in the form of a peel-off label 2 to packages in the form of containers 3.

Figure 4:
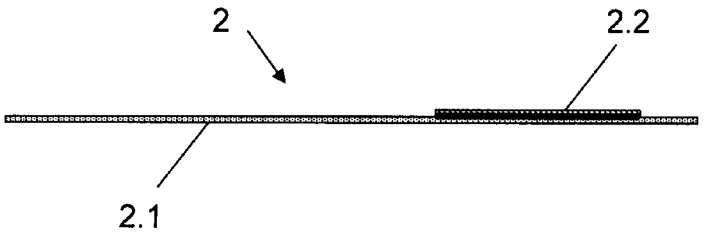
FIG. 4 a simplified section view through one of the peel-off labels.
Figure 3:
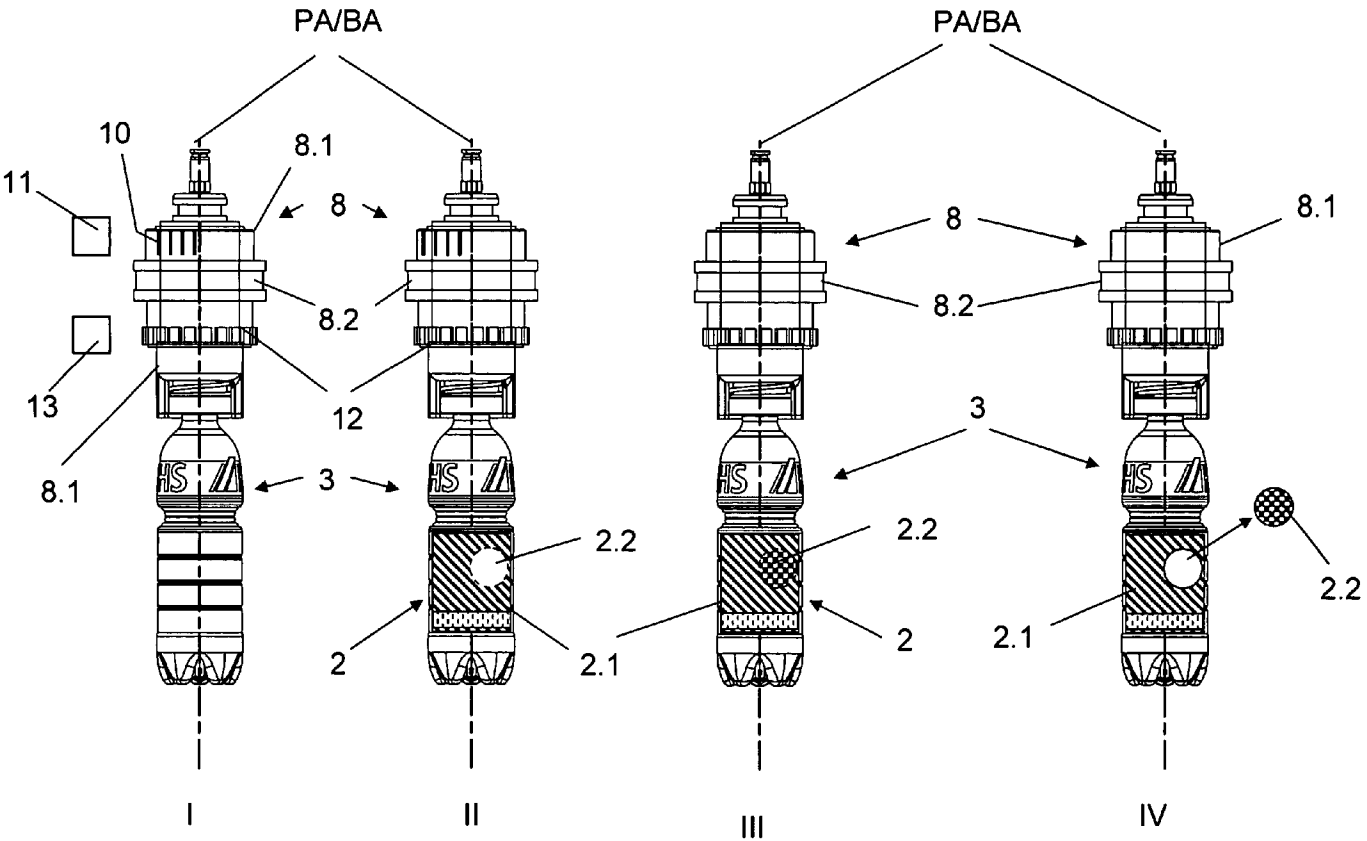
FIG. 3 in positions I-IV respectively, a container in the form of a bottle before application of the peel-off label (position I), after application of the peel-off label (position II), after printing of the part label of the peel-off label (position III), and after detachment of the part label (position IV)

As shown in particular in FIGS. 3 and 4, the peel-off labels are each multilayer labels, substantially consisting of a carrier label 2.1 of a flat material, for example a transparent flat material, and a part label 2.2 provided on a surface side of the carrier label 2.1 and covering only a part region of the respective surface side of the carrier label 2.1.

The carrier label 2.1 is already printed corresponding to the necessary and/or desired decoration before application to the container 3. For example, in the case of a transparent carrier label 2.1 it is also printed on the back or the surface side facing away from the part label 2.2. The part label 2.2 initially has no decoration features but forms an empty field. This part label 2.2 is only printed with its decoration features (part decoration) after application of the peel-off label to the respective container 3 inside the first device 1. In some embodiments the part decorations are multicolored.

The particular advantage of the foregoing arrangement is that during production, the content and/or form of the part decoration of the part label 2.2 can be modified and/or updated directly and without delay. This is useful for event-related printing responsive to current events e.g. sporting events etc. In particular it is also possible to apply, to the part labels 2.2, different and/or sequentially changed lottery numbers, e.g. bingo numbers, or to design the part label 2.2 as a collection label.

The peel-off labels 2 are applied to the containers 3 on their surface side facing away from the respective part label 2.2 such that the adhesion strength between the carrier label 2.1 and the respective container 3 is substantially greater than the adhesion strength between the carrier label 2.1 and the part label 2.2. As a result, the latter can be detached from the carrier label 2.1, for example, by the customer. The peel-off labels are, for example, designed as self-adhesive labels on the surface side facing away from the part label 2.2, or are fixed onto the respective container 3 on this surface side with a glue layer, and/or are designed as looped labels surrounding the container 3.

In the embodiment shown, the first device 1, to which the containers 3 fitted with the peel-off labels are supplied at a container or package inlet 1.1, and from which the containers 3 fitted with the peel-off labels 2 are removed at a container or package outlet 1.2, includes several modules 4.1-4.8 that form a transport system with multiple transport elements 5 that can be driven in circulation about a vertical machine axis MA. In the embodiment shown, the transport elements 5, which are in the form of transport stars of all modules 4.1-4.8, are designed identically. On their respective peripheries, each one forms several container-receiving and/or treatment positions 6 that are distributed at even angular distances about the respective machine axis MA and provided at the same radial distance from the machine axis MA. The transport elements 5, in the manner to be described further below, form a container transport line 7 on which the containers 3 are moved in a transport direction A from a package inlet 1.1 to a package outlet 1.2 during their treatment.

The first device 1 furthermore comprises a plurality of holding-and-centering units, or pucks 8, of which one puck 8 is shown in each of positions I-IV of FIG. 3. The pucks 8 hold the containers 3 at their tops or in the region of their container mouths, closed by closures, during transport along the container transport line 7. The pucks orient the suspended containers 3 by rotation or swiveling about their vertical or substantially vertical container axes BA. The pucks 8 are each formed in at least two parts, namely comprising a primary part 8.1 and a holding part or ring 8. The primary part 8.1 is mounted to be rotatable around the puck axis PA and is arranged coaxial with the container axis BA. During treatment of the containers 3, the primary part 8.1 is held at a receiving or treatment position 6 of a transport element 5. The primary part 8.1 is formed with a suitably gripper-like underside to hold the container 3.

At the package inlet 1.1, each container 3 is picked up by a puck 8 and moved on one and the same puck 8 through the container transport line 7 to the package outlet 1.2. Only there is the respective container 3 released from the associated puck 8. The pucks 8 are then returned on a puck transport line 9, indicated by dotted lines in FIG. 1, to the package inlet 1.1 or to a module 4.1 forming the package inlet.

For controlled orientation and/or rotation of the containers 3 during treatment, the primary part 8.1 has at least one coding 10 that is detected by an increment sensor 11 arranged at the respective receiving and/or treatment position 6. Together, these form an encoder system that supplies an encoder signal for the controlled orientation and/or rotation of the containers 3 about their container axis BA. Furthermore in the embodiment shown, the primary part 8.1 of each puck 8 is formed as a rotor of an electric actuator for the controlled orientation and/or rotation of the containers 3, and for this has an annular permanent magnet arrangement 12 that surrounds the puck axis PA concentrically and forms magnetic north and south poles alternating successively in the peripheral direction and lying radially on the outside. The annular permanent magnet arrangement 12 cooperates with an electric magnet arrangement 13 that is provided at the respective receiving and/or treatment position 6 and that forms the stator of the electric actuator.

Figure 2:
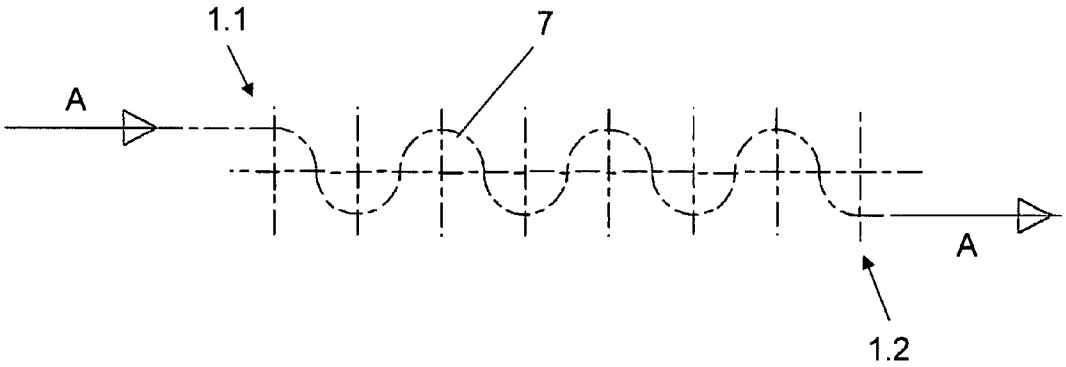
FIG. 2 is a diagram of a top view of a transport and conveying line of the packages or containers through the device in FIG. 1.

As stated above, the containers 3 are each held suspended on a puck 8 and moved through the transport line 7 formed by the transport elements 5. To achieve this, the transport elements 5 are driven at the same speed or in synchrony but with different directions of rotation. In the depiction shown in FIG. 1, the transport elements 5 of modules 4.1, 4.3, 4.5 and 4.7 are moved clockwise and transport elements 5 of modules 4.2, 4.4, 4.6 and 4.8 are moved counterclockwise. The transport elements 5 are furthermore driven such that whenever a receiving and/or treatment position 6 of a transport element 5 has reached a delivery position between two modules 4.1-4.8, a receiving and/or treatment position 6 of an adjacent transport element 5 is ready to deliver or receive the puck 8. The modules 4.1-4.8, or their transport elements 5, are thus adjacent to each other for transport, and the pucks 8 with the containers 3 held thereon are moved on the meander-like transport line 7 as indicated diagrammatically in FIG. 2.

At the part of the treatment line 7 formed by the module 4.2, a labeling machine 14 is provided with which the peel-off labels 2 are applied to the containers 3. In the embodiment shown, the labeling machine 14 is configured to process a label material 15 that consists of a carrier strip 16 (for example silicone-coated paper) and the self-adhesive peel-off label 2 provided on the carrier strip 16. The label material 15 is guided via a dispenser edge at a label delivery region of the labeling machine 14, in the manner known to the person skilled in the art, so that a leading region of each peel-off label 2, in relation to the transport direction of the label material 15, remains adhering to a container 3, which is moved past the dispenser edge, and is then fully applied to the container by the controlled rotation of the container 3 with the associated puck 8 about the container axis BA. The remaining carrier strip 16 is wound up in the labeling machine 14. The labeling machine 14 is thus driven in synchrony with the rotational movement of the transport element 5 of the module 4.2.

If the containers 3 are fitted with a package or container feature, for example with an embossing and/or relief, and it is necessary to apply the peel-off labels 2 here in a predefined position in relation to the respective container feature. As a result, it is preferable if, before application of the peel-off labels 2 to the containers 3, these containers are oriented by a controlled rotation of the primary part 8.1 of the puck 8 that holds the container 3, about the respective puck axis PA. This can be carried out based on data from modules 4.1 and 4.2, which detect, e.g. by optical detection, the relevant container feature.

On the part of the treatment line 6 formed by the transport elements of modules 4.3-4.7, the decoration features or part decoration are then applied to the part label 2.2, preferably as a multicolor print, at the receiving or treatment position 6 there. To carry this out, print heads 6.1 are provided at these treatment positions. Examples of such print heads are those inkjet print heads. These can be used for printing during controlled rotation of the primary parts 8.1 of the puck 8, and hence the container 3 held at the puck 8, about the puck axis PA or container axis BA.

In the embodiment shown, multiple print heads are provided at each transport element 5 of modules 4.3-4.6, or at the receiving and/or treatment positions 6 thereon. Each one prints a color, black, cyan, magenta and yellow. The receiving and/or treatment positions 6 of the transport element 5 of module 4.7 serve e.g. for further processing of the labeled and also printed containers 3. Thus, module 4.7 is, for example, formed as a drying module in which the respective, previously printed, multicolor print is definitively dried in a suitable manner, for example by energy application, e.g. by heat, and/or UV radiation. The module 7 can be an inspection module at which the decoration of the containers 3, and in particular the multicolor print applied to the part labels 2.2, is checked for possible faults.

It has been assumed above that the labeling device 14 for processing the labeling material 15 is formed with the self-adhesive peel-off labels 2. However, other labels and labeling schemes can be used. For example, labeling machines that are suitable for processing other label materials, for example endless label material, and/or for processing peel-off labels 2 formed as individual labels, in particular also labeling machines for processing peel-off labels formed as all-round labels. Furthermore the labeling machines can also be equipped with devices for application of glues or adhesive layers to the peel-off labels 2 and/or the containers 3.

Figure 5:
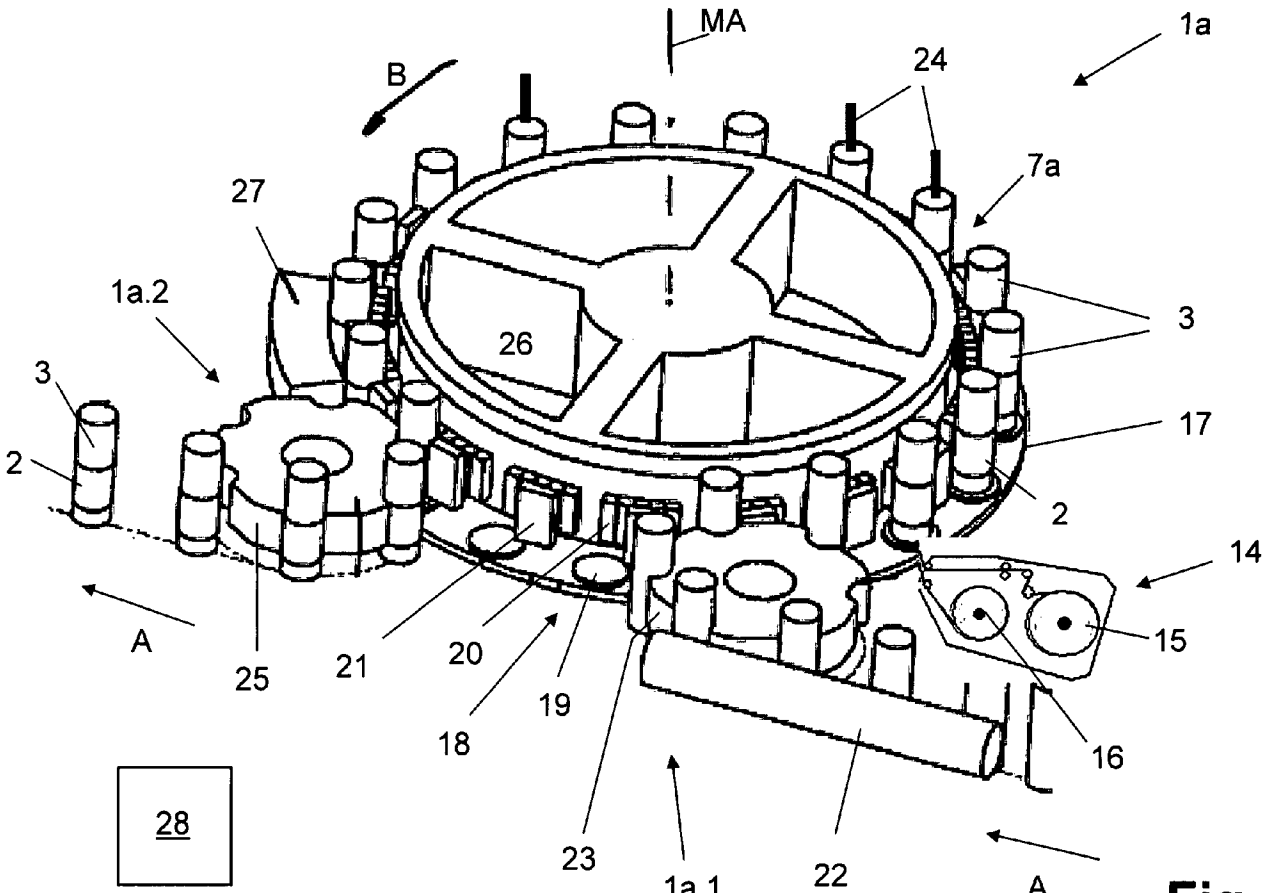
FIG. 5 is a simplified perspective view of a further device for application of a decoration in the form of a peel-off label to packages in the form of containers.

FIG. 5 shows a second device 1*a* that again applies a decoration to a package, which is in the form of a container 3. The second device 1*a* applies peel-off labels 2 and subsequently prints on the initially empty part labels 2.2. The second device 1*a*, however, differs from the first device 1 in that the transport system or treatment or container transport line 7*a* is formed by a single rotor 17 that can be driven to rotate about the vertical machine axis MA, which on its periphery has a plurality of receiving and treatment positions 18, distributed at even angular distances about the machine axis MA and at the same radial distance from the machine axis MA. Each treatment position 18 is formed with a container carrier 19 that can be rotated under control about a vertical axis in the form of a container plate with a printing station 20 having several print heads, and with a device for at least preliminary drying of the printing ink, and with a sensor device 21 for detection of orientation features, e.g. for detection of package or container features and/or markings, in particular prints and printing marks.

The containers 3 to be treated are supplied to the device 1*a* at a package inlet 1*a*.1, here first brought to the required machine spacing or pitch via a divider worm 22 and then delivered via an inlet star 23 to a receiving and/or treatment position 18 or the container carrier 19 there, at which the containers 3 are arranged standing on their container base and with their container axis oriented in the vertical direction. These are secured or clamped at the respective receiving and/or treatment station 18 by plungers 24 or other suitable elements that are provided at each receiving and/or handling position 18 and that lie against the top of the container 3. At the package outlet 1*a*.2, the treated containers 3 are taken from the treatment and handling position 18 via an outlet star 25.

At the angular region of the rotation movement of rotor 17 between the package inlet 1*a*.1 and package 1*a*.2, the containers 3 are decorated, initially by application of the peel-off labels 2, and then by printing of the previously empty part labels 2.2 with a multicolor print by the print heads 20.

If the containers 3 again have special container features in relation to which the peel-off labels 2 are to be applied, the containers 3 are first oriented, by detection of their container outer surface with the sensor device 21, in relation to the respective container feature before they reach the delivery region of the labeling machine 14 with the circulating rotor 17. Using the labeling machine 14, the peel-off labels 2 are applied to the oriented containers 3 in the required spatial arrangement in relation to the respective container feature. The labeling machine 14 can also be formed in widely varying ways at the device 1*a*.

At the angular region of the rotation movement of the rotor 17 following the labeling machine, the multicolor printing of the part labels 2.2 takes place with the associated printing station 20 or print heads there. Each print head generates a color set of the multicolor print, for example in yellow, magenta, cyan and black. The print heads of each printing station 20 are preferably again those that work on the known inkjet print head principle, or the toner jet or inkjet principle. The respective color set is applied under controlled rotation of the container carrier 19 concerned and hence of the container 3 arranged thereon about the container axis BA.

After application of a color set, the print is at least provisionally dried or hardened by a special device at the respective print station 20. Then, for example, after further orientation of the respective container 3, e.g. by detection of at least one marking previously produced by printing and/or another orientation feature, the further color set of the multicolor print is applied, again by controlled rotation of the container 3 about its container axis BA.

For application of the different color sets, the printing stations 20, or their print heads, are adjustable relative to the container carriers 19 and hence relative to the containers 3 arranged thereon in the peripheral direction of the rotor 17, i.e. they can be swiveled under control about the machine axis MA by an angular region so that the print head competent for the color set to be applied is arranged directly adjacent to the respective container 3 or the part label 2.2 to be printed. This approaching movement of the print heads is controlled individually or independently for each receiving and/or treatment position 18, namely as a function of the rotary position of rotor 17.

A drying element 27 is provided in front of the package outlet 1*a*.2 on the movement path of the containers 3. The drying element 27 does not rotate with the rotor 17.

It has been assumed above that a peel-off label 2, which includes a carrier label 2.1, and the detachable part label 2.2 form the container decoration. In principle, it is also possible that the decoration of the respective container includes a preferably multicolor print applied directly onto the container as the main decoration, and a detachable part label corresponding to the part label 2.2, which is applied by labeling onto the respective container 3 and is then multicolor-printed in the manner described above.

In this case, on the treatment line upstream of the labeling machine for application of the detachable part labels, the corresponding device has at least one printing station for multicolor printing of the containers, or the printing stations downstream of the labeling machine for application of detachable part labels on the treatment line in the transport direction also serve for application of preferably multicolor prints to the container 3 and for application of the multicolor prints, for example topically adaptable and/or modifiable, to the detachable part labels.

At the devices 1 and 1*a*, the print stations 6.1 and 20 or their print heads are each controlled electronically by a computer 28 in which the printing masks necessary for printing the part label 2.2 are stored digitally, i.e. as digital data sets, and/or entered. This creates the possibility of changing or updating the prints on the part labels 2.2 easily and without delay or without significant delay.

If the main decoration is also applied to the container 3 by printing, preferably separate printing masks are stored in the computer 28 for the main decoration and for printing the part labels 2.2. This enables prints on the part labels 2.2 to be easily be changed without delay. It also enables a corresponding change of the container print that forms the main decoration. For the printing process, a complete printing mask is formed in the computer 28 from the printing mask corresponding to the respective color set of the main decoration and from the mask corresponding to this color set for printing the part labels. The print heads 6.1 or 20 or the print heads corresponding to the color set are controlled with this mask.

The invention has been described above with reference to exemplary embodiments. It is evident that numerous changes and derivations are possible without leaving the concept which is fundamental to the invention.

LIST OF REFERENCE NUMERALS

1, 1*a* Device
1.1, 1*a*.1 Packaging means inlet
1.2, 1*a*.2 Packaging means outlet
2 Peel-off label
2.1 Carrier label
2.2 Part label
3 Container or bottle
4.1-4.8 Treatment module
5 Transport element
6 Receiving and treatment position
6.1 Printing station
7 Treatment line
8 Puck
8.1 Primary part
8.2 Holder ring
9 Puck transport line
10 Coding
11 Increment sensor
12 Permanent magnet arrangement
13 Electromagnet arrangement
14 Labeling machine
15 Labeling material
16 Carrier material or carrier strip
17 Rotor
18 Receiving and/or treatment position
19 Container carrier or bottle plate
20 Printing station
21 Sensor device
22 Divider worm
23 Inlet star
24 Plunger
25 Outlet star
26 Carrier
27 Drying unit
28 Computer

The invention claimed is:

1. A method for treating packages, said method comprising applying decorations to said packages, wherein applying decorations comprises applying a main decoration to said package, applying a detachable part label with a reduced adhesion strength to said package, said reduced adhesion strength being an adhesion strength that is smaller than an adhesion strength of said main decoration, wherein said part label is provided on a region of said main decoration and takes up part of a surface region of said main decoration, and after having applied said detachable part label to said package, printing on said part label, which is on said package, by using a digital printing process controlled by a computer that relies on a digital printing mask that is at least one of stored on and generated by said computer, wherein said computer controls at least one print head to cause said print head to print a print on said part label after said part label has been applied to said package.

2. The method of claim 1, wherein printing on said part label comprises using multiple print heads to generate a different color set of a multicolor print.

3. The method of claim 1, wherein applying said main decoration comprises printing on an outer surface of said package, and wherein printing on said part label is carried out after applying said main decoration.

4. The method of claim 1, further comprising applying a peel-off label that includes said main decoration and said detachable part label, wherein said peel-off label comprises a carrier label that forms said main decoration, and wherein said part label is provided detachably on said carrier label with said reduced adhesion strength.

5. The method of claim 4, further comprising, using a transporter, moving said packages past a labeling machine, and causing said labeling machine to apply said peel-off label, wherein printing on said part label comprises using said labeling machine to print on said part label.

6. The apparatus of claim 1, wherein printing on said part label comprises orienting a package after application of said part label by at least one of controlled rotating and swiveling of said package about a package axis thereof in relation to an orientation feature.

7. The method of claim 1, further comprising arranging said package on a package carrier, and at least one of rotating and swiveling said container using said package carrier for at least one of orientation and application of at least one of said main decoration and said part label during printing.

8. An apparatus of treating packages by application of a decoration to said package, said decoration comprising a main decoration and a detachable part label with a reduced adhesion strength, said reduced adhesion strength being an adhesion strength that is smaller than an adhesion strength of said main decoration, wherein said part label is provided on a region of said main decoration and takes up part of a surface region of said main decoration, said apparatus comprising a plurality of transport elements that cooperate to form a package transport line, on a transport element, package receivers for holding said packages, printing stations on said package transport line for printing on said detachable part label while said detachable part label is already on a package, and a computer configured to control said printing stations based on a digital printing mask that is at least one of stored on and generated by said computer.

9. The apparatus of claim 8, wherein said package receivers are configured for controlled orientation of a package during treatment thereof.

10. The apparatus of claim 8, wherein said transport element is rotatable, and wherein said printing station is provided on said transport element.

11. The apparatus of claim 8, wherein said transport elements are adjacent to each other for transport, wherein said apparatus further comprises a labeling station having a labeling machine, wherein said labeling station is provided at one of said transport elements, and wherein said printing station moves with said one of said transport elements.

12. The apparatus of claim 11, wherein said transport element comprises a rotor that can rotate about a vertical machine axis, wherein said rotor comprises plural package receiving-and-transport positions, wherein said printing station comprises plural print heads, wherein said printing station is adjustable relative to said transport element, and wherein said printing station moves with said transport element.

13. The apparatus of claim 11, wherein said labeling station is configured to process peel-off labels.

14. The apparatus of claim 8, further comprising a package inlet, and a labeling station, wherein said labeling station comprises a labeling machine downstream of said package inlet.

15. The apparatus of claim 8, further comprising a package inlet, a package outlet, and a puck transport line, wherein said package receiver comprises a puck that picks up a package at said package inlet, drops off said package at said package outlet, and returns to said package inlet via said puck transport line.

16. The apparatus of claim 15, wherein said puck is configured to suspend said package.

17. The apparatus of claim 15, wherein said plurality of transport elements comprises a first transport element and a second transport element, wherein said puck is configured to carry said package in said first transport element, wherein said puck is configured to carry said package in said first transport element, and wherein said puck is configured to move from said first transport element to said second transport element while carrying said package.

18. The apparatus of claim 15, wherein said plurality of transport elements comprises a plurality of star-wheels, each of which has the same diameter.

19. A method for labeling packages, said method comprising applying multilayer labels to each of a plurality of packages, each of said multilayer labels comprising a carrier label and a part label that covers part of a surface of said carrier label, wherein said carrier label is configured to adhere to said package with a first adhesive strength, wherein said part label is configured to adhere to said carrier label with a second adhesive strength, and, with said part labels already having been applied to said packages, printing on each said each of said part labels by using a digital printing process controlled by a computer that relies on a digital printing mask and controls a print head.

20. The method of claim 19, wherein printing on each of said part labels comprises printing a first number on a first part label that adheres to a first carrier label that adheres to a first package and printing a second number on a second part label that adheres to a second carrier label that adheres to a second package, wherein said first number is different from said second number, wherein, as a result, each of said packages in said plurality of packages is labeled with a different number on a part label thereof.

* * * * *